US008276494B2

(12) United States Patent
Palkowitsh

(10) Patent No.: US 8,276,494 B2
(45) Date of Patent: Oct. 2, 2012

(54) BULLET FEED DIE ASSEMBLY

(75) Inventor: Gregory Lee Palkowitsh, Wood River, NE (US)

(73) Assignee: Hornady Manufacturing Company, Grand Island, NE (US)

( * ) Notice: Subject to any disclaimer, the term of this patent is extended or adjusted under 35 U.S.C. 154(b) by 255 days.

(21) Appl. No.: 12/587,515

(22) Filed: Oct. 8, 2009

(65) Prior Publication Data

US 2011/0083546 A1 Apr. 14, 2011

(51) Int. Cl.
*F42B 33/00* (2006.01)

(52) U.S. Cl. ..... 86/45

(58) Field of Classification Search ..... 86/23, 43, 86/45, 12, 28, 29, 33, 47, 40, 39, 25, 37, 86/36

See application file for complete search history.

(56) References Cited

U.S. PATENT DOCUMENTS

| | | | | | |
|---|---|---|---|---|---|
| 2,970,508 | A * | 2/1961 | Wicks | 86/23 |
| 3,602,084 | A * | 8/1971 | Corcoran | 86/43 |
| 3,857,319 | A * | 12/1974 | Welch | 86/23 |
| 4,088,332 | A * | 5/1978 | Chase | 279/2.04 |
| 4,475,435 | A * | 10/1984 | Mantel | 86/26 |
| 4,522,102 | A * | 6/1985 | Pickens | 86/27 |
| 4,573,392 | A * | 3/1986 | Mantel | 86/43 |
| 5,179,243 | A * | 1/1993 | Schroeder | 86/25 |
| 5,763,810 | A * | 6/1998 | Lee | 86/45 |
| 6,041,687 | A * | 3/2000 | Fowler | 86/45 |
| 2002/0121184 | A1 * | 9/2002 | Fowler | 86/45 |
| 2010/0275762 | A1 * | 11/2010 | Koch et al. | 86/43 |

* cited by examiner

*Primary Examiner* — Bret Hayes
*Assistant Examiner* — Reginald Tillman, Jr.
(74) *Attorney, Agent, or Firm* — Bennet K. Langlotz; Langlotz Patent & Trademark Works, Inc.

(57) ABSTRACT

Bullet feed die assemblies include a die defining an interior passage that encloses a first collet and a second collet. The first collet defines a first bullet passage bore, and the second collet defines a second bullet passage bore. The first collet and the second collet are positioned coaxially within the interior bore of the die. The collets are operably engaged to generate bore expansion of one of the bullet passage bores and bore restriction of the other bullet passage bore upon application of an axial force to the collets.

25 Claims, 7 Drawing Sheets

BULLET FEED DIE ASSEMBLY

FIELD OF THE INVENTION

The present invention relates to ammunition manufacturing machinery, and more particularly to controlled feeding of bullets.

BACKGROUND OF THE INVENTION

Modern rifle and handgun cartridges have four components: the cartridge case, the primer, the propellant, and the bullet. The most costly and critical component of a cartridge is the case. Not only does it hold all of the other components, but the case provides a precision seal that ensures expanding gases remain in the firearm and efficiently push the bullet out of the firearm's barrel.

The brass case is often capable of being reused several times before it is no longer suitable for use. Because the case accounts for about 65% of the cost of ammunition, many shooters are therefore motivated to reduce their cost per shot by reloading spent cases for reuse.

However, reducing the cost per shot is not the only factor motivating the reloading of spent cases. Reloaders are able to custom tune the reloaded ammunition to their firearm's particular characteristics. Adjusting the cartridge length to the maximum the firearm will allow can greatly improve accuracy, as can loading the cartridge with a particular bullet weight or style. Furthermore, a reloader can safely assemble reduced velocity ammunition that will subject an inexperienced shooter to less recoil. Finally, reloading enables owners of obsolete firearms to continue to shoot even when factory ammunition is no longer available.

The process of reloading ammunition requires a reloading press, powder measure, priming system, calipers, scale, and a set of reloading dies. The press is a specialized device designed expressly for reloading ammunition. It holds the reloading dies in precise alignment and provides mechanical advantage required to recondition the cartridge case.

The reloading dies, which typically are a sizing die and a seating die, are customized for the case they are intended to load. The sizing die reshapes the case to the dimensions needed to permit easy chambering. The sizing die also ejects the spent primer by the use of a decaping pin attached to a spindle and ensures the case's mouth is the proper diameter to receive a new bullet when a pistol case is being reloaded. If a rifle case is being reloaded, there is an expander ball on the spindle. The seating die aligns the bullet with the case and pushes it into the case to the desired depth.

In conventional practice, a bullet is placed on the mouth of a charged case and is held in place by the reloader's thumb and forefinger. The case head is placed atop the ram of the press. The ram is raised, pushing the casing neck into the seating die. As this occurs, the user releases the bullet and gives the press handle a full stroke to seat the bullet in the case.

The conventional approach suffers the disadvantage of requiring the user to manually hold a bullet on the mouth of a charged case while raising the ram. This creates the potential for injury and increases the time required to reload a casing. Other conventional bullet feeding mechanisms exist, but are mechanically complex, unreliable, or expensive.

Therefore, a need exists for a new and improved bullet feed die assembly that feeds only a single bullet into a casing. In this regard, the various embodiments of the present invention substantially fulfill at least some of these needs. In this respect, the bullet feed die assembly according to the present invention substantially departs from the conventional concepts and designs of the prior art, and in doing so provides an apparatus primarily developed for the purpose of feeding only a single bullet into a casing.

SUMMARY OF THE INVENTION

The present invention provides an improved bullet feed die assembly, and overcomes the above-mentioned disadvantages and drawbacks of the prior art. As such, the general purpose of the present invention, which will be described subsequently in greater detail, is to provide an improved bullet feed die assembly that has all the advantages of the prior art mentioned above.

To attain this, the preferred embodiment of the present invention essentially comprises a die body defining an interior passage that encloses a first collet and a second collet. The first collet defines a first bullet passage bore, and the second collet defines a second bullet passage bore. The first collet and the second collet are positioned coaxially within the interior bore of the die body. The collets are operably engaged to generate bore expansion of one of the bullet passage bores and bore restriction of the other bullet passage bore upon application of an axial force to the collets. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
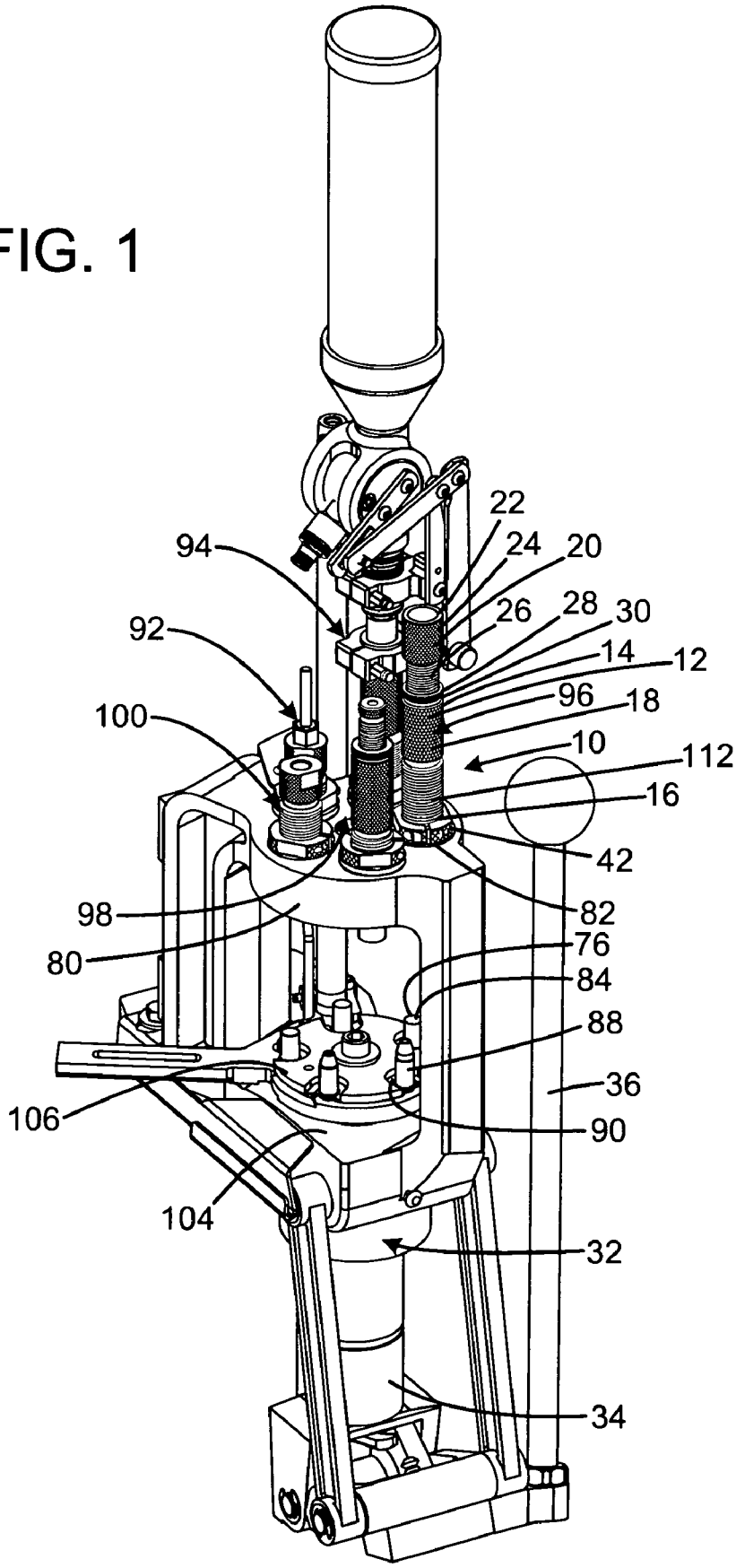
FIG. 1 is a top perspective view of the current embodiment of the bullet feed die assembly constructed in accordance with the principles of the present invention installed in a reloading press.

A preferred embodiment of the bullet feed die assembly of the present invention is shown and generally designated by the reference numeral 10.

FIG. 1 illustrates the improved bullet feed die assembly 10 of the present invention installed in a reloading press 32. More particularly, the press 32 has horizontally-oriented and parallel spaced-apart upper and lower frame portions 80 and 104. The upper frame portion has five threaded tool stations (92, 94, 96, 98, and 100) mounted on it. The lower frame portion receives a reciprocating ram 34. A shell plate 106 with five shell holders 90 is rotatably mounted on top of the ram 34. The plate positions the shell holders such that the cases 76 in the shell holders are axially registered with the five tool stations.

In use, the user places an empty case in the shell holder positioned beneath the first station 92. After giving the press handle 36 a full stroke, the case is sized and its spent primer is removed by the first station with a stroke of the handle.

The case is then moved to the second station 94 by rotating the plate. The plate is rotated mechanically on some presses. An empty case is inserted at the first tool station, which happens after each stage of operation to provide efficient progressive operation. After giving the press handle another full stroke, the first case is primed and loaded with a measured quantity of powder by the second tool station.

This charged case is then moved to the third tool station 96 by rotating the plate. The plate is rotated mechanically on some presses. After giving the press handle another full stroke, the charged case receives a single bullet 40 from the bullet feed die assembly 10 positioned at the third tool station. The bullet feed die assembly is not necessarily always in the third station; the bullet feed die assembly's location depends on how many stations the press that is being used possesses.

The resulting loaded cartridge 88 is then moved to the fourth tool station 98 by rotating the plate. The plate is rotated mechanically on some presses. After giving the press handle a full stroke, the bullet is seated and the neck of the cartridge is crimped by the fourth tool station.

The loaded cartridge is then moved to the fifth tool station 100 by rotating the plate. The plate is rotated mechanically on some presses. After giving the press handle a full stroke, the crimp is tapered by the fifth tool station, and the resulting reloaded cartridge can be removed from its shell holder and is ready for use. The station in which the crimp is tapered depends on the specific press being used; the operation may occur in a different station than the fifth.

The feed assembly is an elongated cylindrical body having mounting threads 112 on the bottom 16 of its bullet feed die 12. These threads are screwed into a threaded bore or socket 82 in the upper frame portion of the press at the appropriate tool station. The upper end 14 of the exterior of the bullet feed die has a knurled portion 18 to provide a gripping surface for screwing the bullet feed die into and unscrewing the bullet feed die from the socket in the press. The bullet feed die assembly will work with any press that has a ⅞-14 thread. A lock ring 42 functions as a lock nut and releasably secures the bullet feed die to the press by locking against the upper surface of the upper frame portion or against the top surface of the socket in the press. When installed in this manner, the die assembly serves as the third of five ammunition reloading tool stations on the press. However, the bullet feed die assembly's location depends on the press's design and can vary. Components for the other tool stations on the press are installed on the upper frame portion in a similar manner.

Figure 2:
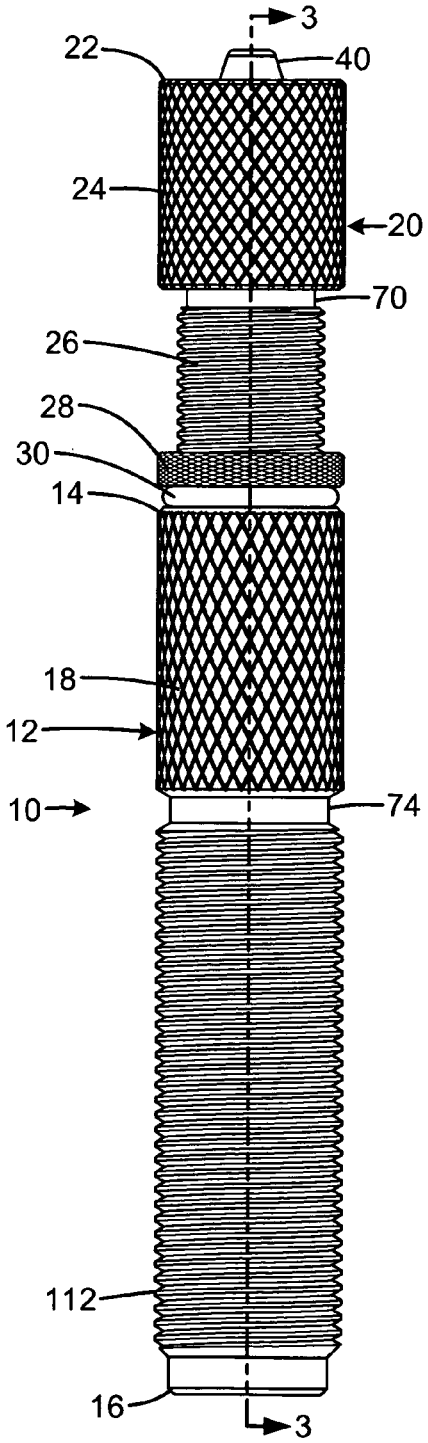
FIG. 2 is a side view of the current embodiment of the bullet feed die assembly of the present invention.

FIG. 2 illustrates the improved bullet feed die assembly 10 of the present invention. The feed assembly essentially serves to drop a single bullet into each case as the press is cycled. More particularly, the feed assembly consists of a bullet feed die body 12, which is a generally tube-shaped body, and a bullet feed adjustment screw 20, which is another tube-shaped body. The exterior 70 of the bottom 46 of the bullet feed adjustment screw has threads 26. The threads 26 are screwed into the top 14 of the bullet feed die body, which is internally threaded with threads 78. The top 22 of the bullet feed adjustment screw has a knurled portion 24 to provide a gripping surface for screwing the bullet feed adjustment screw into and unscrewing the bullet feed adjustment screw from the bullet feed die body. The bullet feed adjustment screw is releasably secured in place by an O-ring 30 and a lock nut 28. The two major components are threaded together to adjust the effective length of the assembly, thereby calibrating the assembly's operation as will be discussed below.

Figure 3:
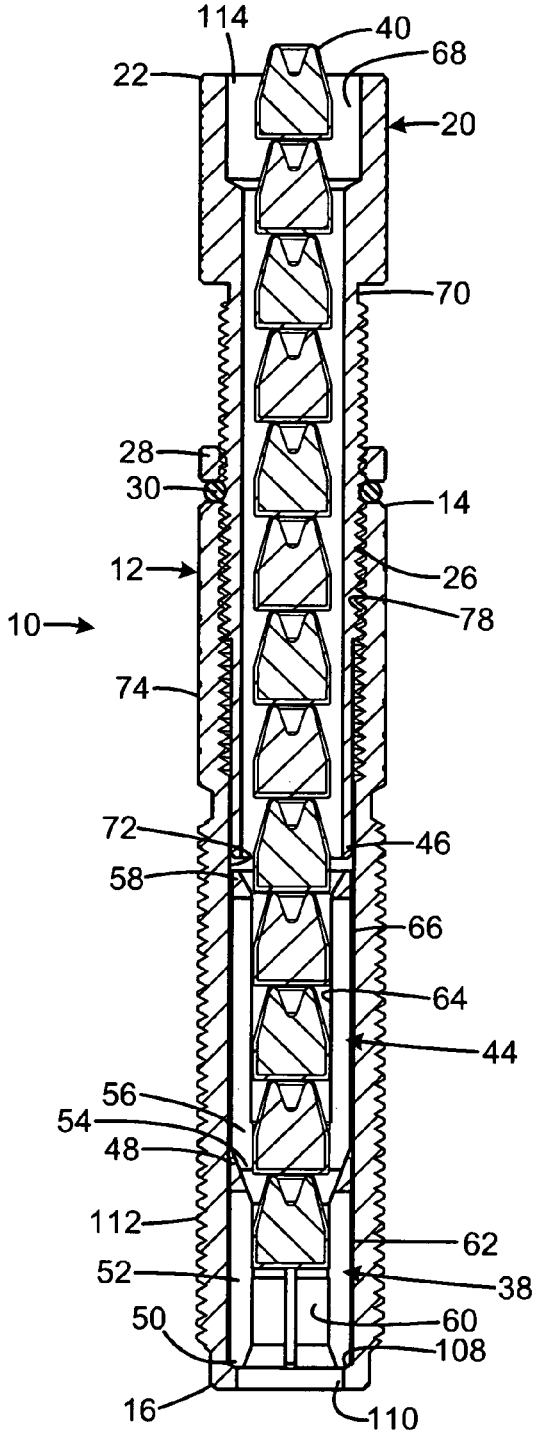
FIG. 3 is a side sectional view of the current embodiment of the bullet feed die assembly of the present invention.

FIG. 3 illustrates the improved bullet feed die assembly 10 of the present invention. More particularly, up to a dozen 9 mm bullets 40 can be fed (tips pointed up, base down) from a hopper (not shown) into an opening 114 at the top 22 of the bullet feed adjustment screw into the die assembly. A longer feed tube (not shown) connects the hopper to the bullet feed die assembly. The feed tube can hold additional bullets in excess of the dozen bullets contained in the feed assembly. The bullet feed die body 12 has a bore diameter of 0.579 inches+/−0.003 inches over its entire length, except for a reduced diameter of 0.479 inches+/−0.005 inches at the lower aperture 110, which provides an internal circumferential ledge surface 108 that faces upward.

The interior 72 of the bullet feed die body below the bullet feed adjustment screw encloses a bullet stop collet 44 and a bullet feed collet 38. The collets are stacked end-to-end in the lower end of the die bore and have diameters only slightly smaller than the feed die bore diameter so that they fit closely, but slide readily, along the length of the bore. The collet diameters are larger than the lower aperture diameter, so that they may not pass through the lower aperture.

A collet is a tubular holding device that forms a collar or sleeve around a cylindrical object to be held and exerts a uniformly-distributed radial clamping force on the object, typically when it is tightened via a tapered outer collar. It may be used to hold a work piece or a tool. A collet's advantages over other types of chucks is that it provides rapid chucking (unclamping of one part, switching to a new part, and re-clamping the new part), it is self centering, it exerts a strong clamping force, it provides considerable resistance against a clamped part being jarred loose, and it centers a clamped part at a high level of precision. It also provides strong gripping forces with relatively low pressure per unit area because the force is broadly distributed over a large area, which is nearly the entire circumference of the cylindrical object being held. This prevents damage to relatively deformable objects, such jacketed or lead bullets.

Figure 4A:
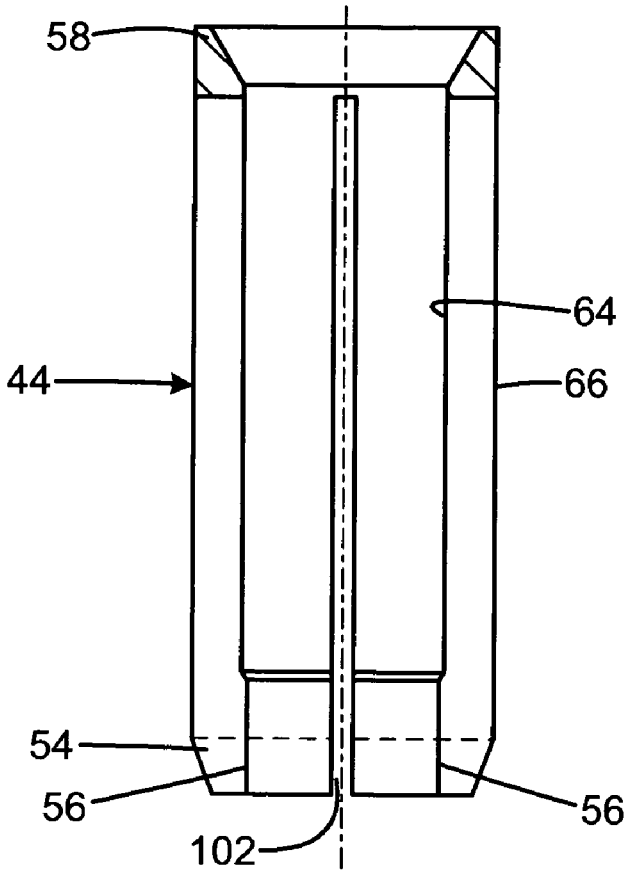
FIG. 4A is a side sectional view of the current embodiment of the bullet stop collet of the present invention.
Figure 4B:
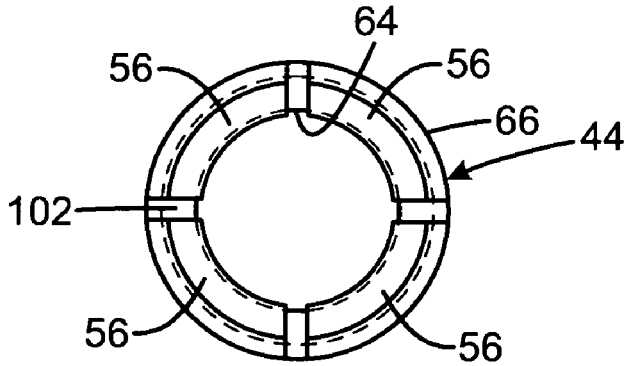
FIG. 4B is a top sectional view of the current embodiment of the bullet stop collet of the present invention.

FIGS. 4A and 4B illustrate the improved bullet stop collet 44 of the present invention. The collet is a tubular body internally tapered or chamfered at the upper end and externally tapered at the lower end. More particularly, the collet's tubular body is divided into four segments by four slits 102 so that the segments are connected only at the top end of the collet. The collet can have more or fewer slits than four and still function normally, provided there is at least one slit.

The interior 64 of the top 58 of the bullet stop collet is tapered outwards at about a 30° angle, providing a flared entrance to the collet's bore. The exterior 66 of the bottom 54 of the bullet stop collet is tapered inwards at about a 20° angle, providing a chamfered nose. The bullet stop collet has four ridges 56 protruding into its interior 64. The slits separate the ridges 56 from one another. The number of ridges is determined by the number of segments the collet has. The topmost portion of the ridges 56 is tapered outwards at about a 30° angle. The ridges 56 reduce the diameter of the interior of a bullet stop collet adapted to fit a 9 mm bullet from 0.375 inches to 0.357 inches. The collet's diameter changes to accommodate different bullet sizes following the formula: stop collet diameter=bullet diameter+0.020 inches. The collet's length is at least 1.5 times the bullet's length. This ensures the stop collet has an adequate amount of flexibility. The collet's angles do not vary with bullet size.

Figure 5A:
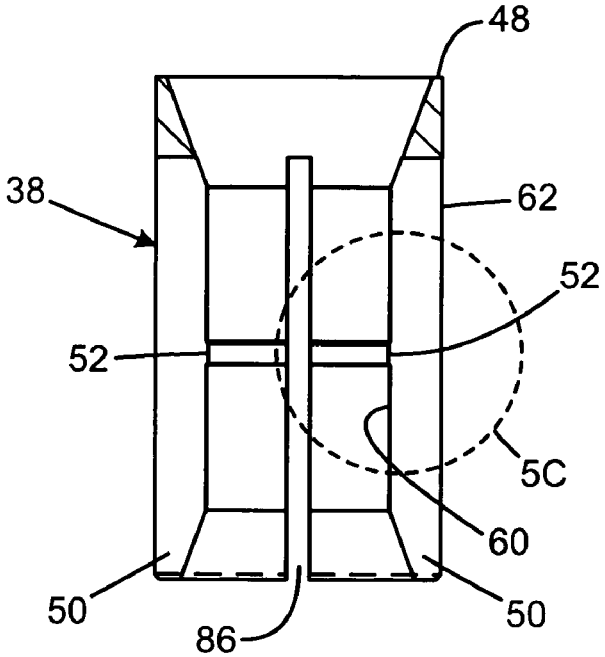
FIG. 5A is a side sectional view of the bullet feed collet of the present invention.
Figure 5B:
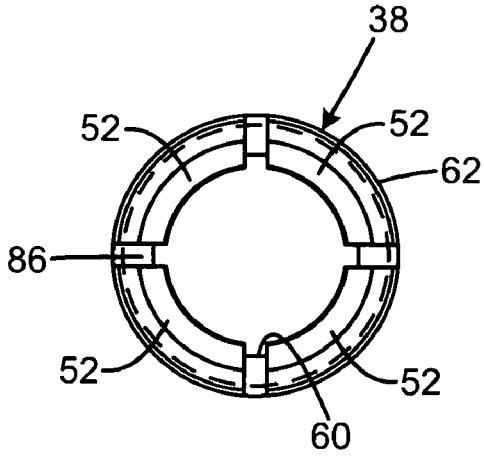
FIG. 5B is a top sectional view of the bullet feed collet of the present invention.
Figure 5C:
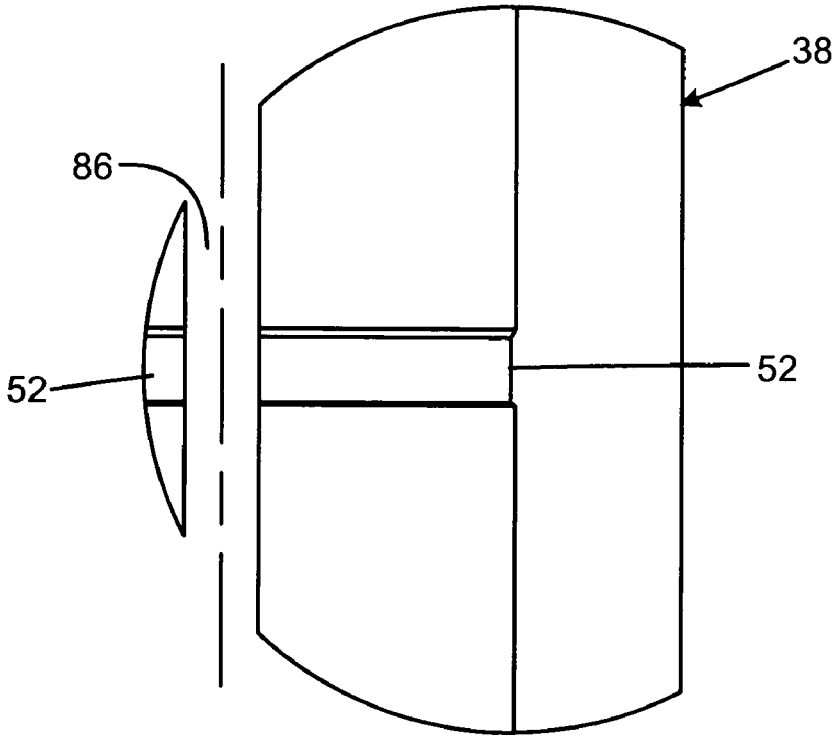
FIG. 5C is a side sectional enlarged view of a ridge of the bullet feed collet of the present invention.

FIGS. 5A, 5B, and 5C illustrate the improved bullet feed collet 38 of the present invention. The collet is a tubular body internally tapered or chamfered at the upper end and at the lower end. More particularly, the collet's tubular body is divided into four segments by four slits 86 so that the segments are connected only at the top end of the collet. The collet can have more or fewer slits than four and still function normally, provided there is at least one slit.

The interior 60 of the top 48 and the bottom 50 of the bullet feed collet are tapered outwards at about a 20° angle to the axis. The bullet feed collet has four petals 52 protruding into its interior 60 at about its midpoint. The number of petals is determined by the number of segments the collet has. The petals are essentially a circumferential feature, except for the slits 86 separating the petals. The topmost portion of the petals 52 is flared outwards at about a 30° angle, and the bottommost portion of the petals 52 is flared outwards at about a 59° angle. This provides a less harsh step surface at both side of the petals than would be provided by a perpendicular face, which serves to avoid damaging bullets with sharp corners and to provide a close conformance to the tapered or chamfered peripheries of the bullets' bases.

When the petals 52 are in a relaxed condition, the petals 52 reduce the diameter of the interior from the bore's 0.36 inch diameter to 0.352 inches in the example of a bullet feed collet adapted to fit a 9 mm bullet. The collet's dimensions change to accommodate different bullet sizes following the formulas: feed collet diameter=bullet diameter+0.004 inches; feed collet length=round up to the nearest 1/100 of an inch the quantity (1.9*bullet length); feed collet lead-in diameter=bullet diameter+0.005 inches; feed collet diameter=bullet diameter−0.002 inches; case lead-in chamfer diameter=case diameter+0.022 inches; feed collet step length=bullet length−0.100 inches. The collet's angles do not vary with bullet size.

Figure 6:
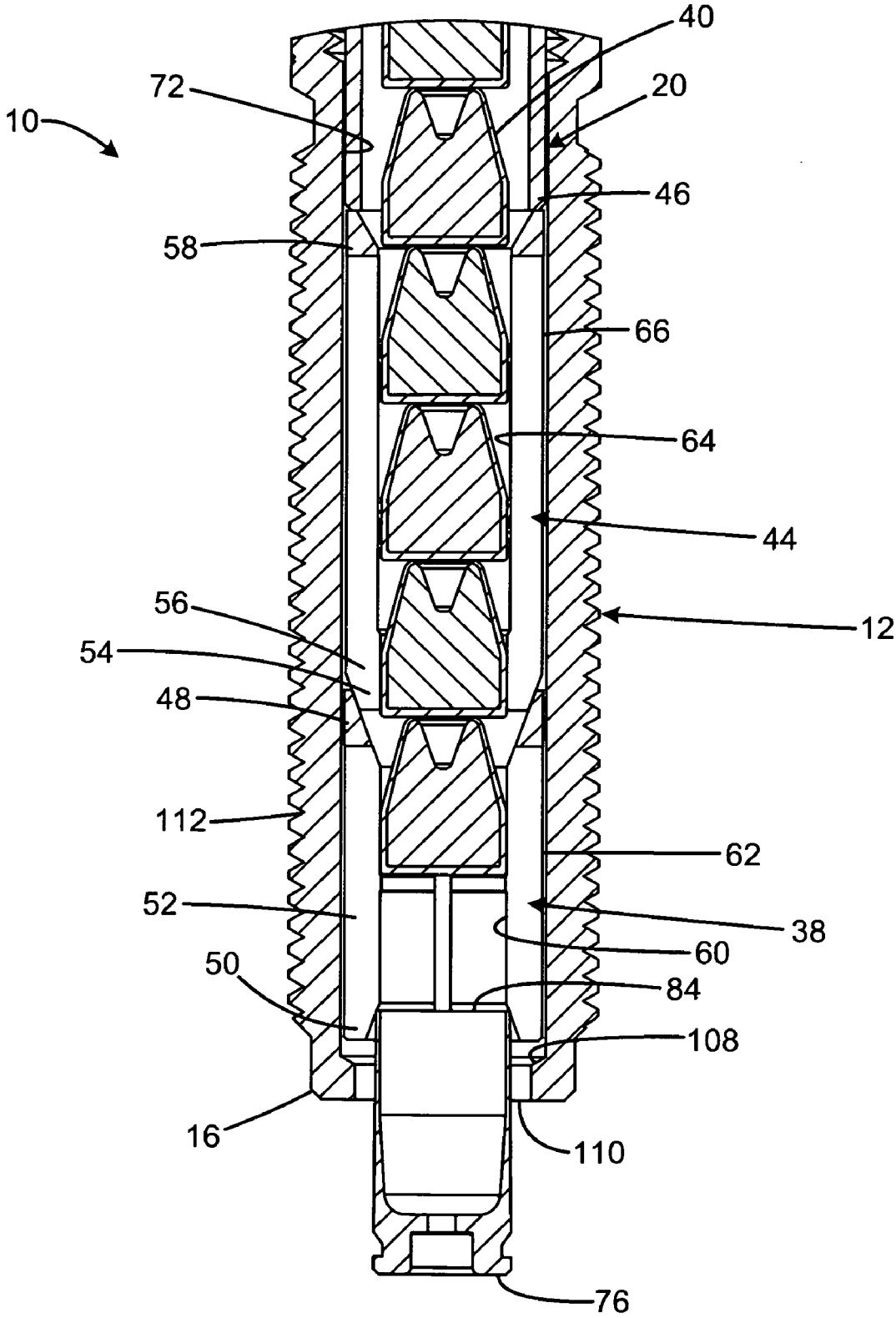
FIG. 6 is a side sectional view of the current embodiment of the bullet feed die assembly of the present invention.

FIG. 6 illustrates the improved bullet feed die assembly 10 of the present invention in the first stage of a sequence of operations performed by the third station of the reloading press during one cycle of the press arm. More particularly, the bullet feed collet 38 is positioned coaxially within the bullet feed die body on a ledge 108 above the bottom opening 110 of the bullet feed die body. The bullet stop collet 44 is positioned coaxially within the bullet feed die body 12 resting on the top 48 of the bullet feed collet and directly below the bottom 46 of the bullet feed adjustment screw 20.

In FIG. 6, the die assembly is depicted at the beginning of the bullet dispensing process performed by the third tool station of the press. A charged case 76 that has previously been processed by the second tool station 94 of the press 32 is held by a shell plate 90. The shell plate coaxially registers the case with the die assembly. The petals 52 of the bullet feed collet are depicted in their relaxed condition. As a result, the petals 52 have a diameter smaller than a bullet 40, so that they prevent passage of the lowest bullet, and the base of the lowest bullet rests on the topmost portion of the ridges. This prevents the column of bullets from falling out the bottom 16 of the bullet feed die body 12.

The handle 36 of the press has been partially lowered to raise the ram 34 and the charged case 76. The mouth 84 of the case pushes against the bottom 50 of the bullet feed collet 38, which pushes the collet 38 upward. This upward motion and pressure presses against the stop collet 44 and raises both collets within the bullet feed die body 12. The collets rise until the top 58 of the bullet stop collet is stopped by the bottom 46 of the bullet feed adjustment screw 20. At the illustrated moment, the upward motion of the mouth is not yet completed, so the petals 52 of the bullet feed collet 38 continue to obstruct the bottommost bullet 40, which prevents it from dropping into the mouth of the case until the upward motion and force continue as discussed below.

Figure 7:
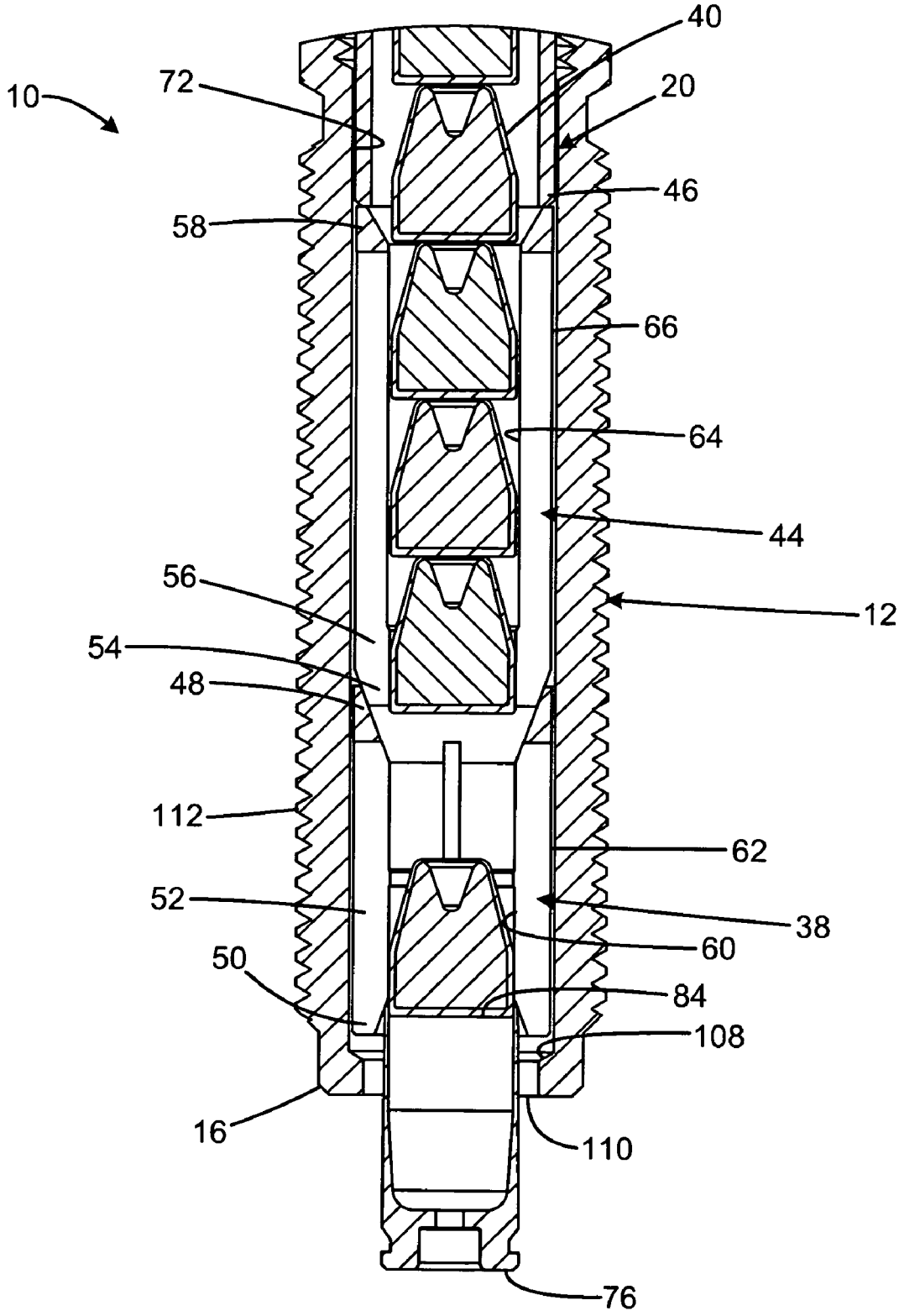
FIG. 7 is a side sectional view of the current embodiment of the bullet feed die assembly of the present invention.

FIG. 7 illustrates the system with the press fully activated to apply upward pressure by the ram, creating compression in the collet stack. The bullet stop collet and bullet feed collet act together to ensure only one bullet 40 at a time is fed into the case. The feed assembly is case activated, meaning that if a case is not inserted into the bullet feed collet, no bullets can pass through the bullet feed die assembly. The lowest bullet cannot pass between the petals unless the mouth 84 of the case is inserted into the interior of the bottom of the bullet feed collet through opening 110 and initiates a process that spreads the petals 52 wide enough to let a bullet pass. This widening of the petals 52 is permitted by the presence of the slits 86, which enable the petals to be forced apart.

However, when the lowest bullet is dispensed into the case, the ridges 56 of the bullet stop collet grip the next lowest bullet when the top 48 of the bullet feed collet rides up over the bottom of the bullet stop collet and tightens the ridges 56 of the bullet stop collet. This tightening of the ridges 56 is facilitated by the presence of the slits 102, which enables the ridges to be compressed together. Only when the mouth of the case is withdrawn and the ridges return to their relaxed state do the ridges permit the next lowest bullet to pass through the bullet stop collet. By this time, though, the petals of the bullet feed collet have returned to their relaxed state, so the now lowermost bullet cannot pass between the petals.

In FIG. 7, the die assembly is depicted at the midpoint of the process performed by the third station of the press. The handle 36 is fully lowered so that the ram 34 is raised into its uppermost position. The charged case 76 is inserted to its maximum depth into the bottom 16 of the bullet feed die body 12 and is exerting its maximum pressure on the collets 38 and 44, which are squeezed axially between the mouth 84 of the case and the bottom 46 of the bullet feed adjustment screw 20. The depth of the bullet feed adjustment screw determines how much distance the case must travel within the bullet feed die body in order to exert sufficient force to dispense the bottommost bullet.

The axial squeezing force exerted by the mouth 84 of the case 76 and the bottom 46 of the bullet feed adjustment screw 20 acts on the collets 38 and 44 in the following manner. The force exerted by the bullet feed collet 38 and the bullet feed adjustment screw on the bullet stop collet 44 forces the bullet stop collet's ridges 56 together and closes its slits 102. This action grips the bottom of the sides of the second bullet 40, which prevents the column of bullets from dropping. Simultaneously, the force exerted by the bullet stop collet and the mouth of the case on the bullet feed collet 38 spreads the bullet feed collet's petals 52 apart and widens its slits 86. The slits 86 continued to widen as the petals 52 spread apart. Once the petals 52 have spread sufficiently wide, they permit the bottommost bullet to drop through the bottom 50 of the bullet feed collet into the mouth of the case. The immediate aftermath of both of these actions on the collets is depicted in FIG. 8.

The maximum amount of collet displacement occurs when the bullet feed collet's exterior 62 contacts the interior 72 surface of the bullet feed die body 12. However, a single bullet is normally reliably dispensed before this condition is reached.

Figure 8:
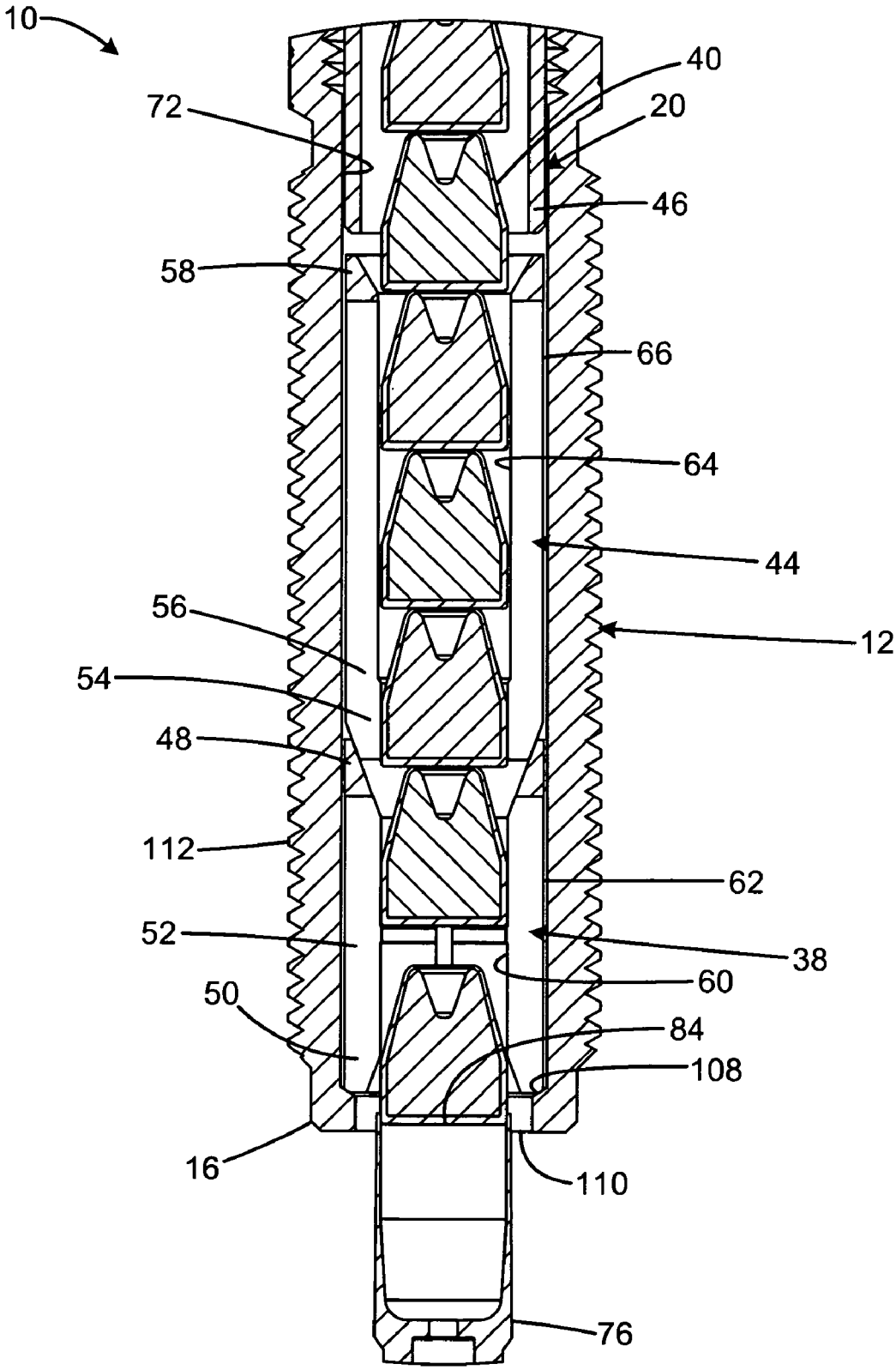
FIG. 8 is a side sectional view of the current embodiment of the bullet feed die assembly of the present invention.

FIG. 8 illustrates the improved bullet feed die assembly 10 of the present invention. More particularly, FIG. 8 shows the die assembly at the end of the bullet dispensing process performed by the third tool station of the press. The handle 36 has been partially raised so that the ram 34 has moved partially downwards towards its fully open position. The case 76 has been withdrawn from the bottom 16 of the bullet feed die body 12 and no longer exerts pressure on the collets 38 and 44, both of which are now in their relaxed condition. The collets have returned to the bottom 16 of the bullet feed die body. The ridges 56 of the bullet stop collet 44 have returned to their relaxed (open) state, which has permitted the column of bullets 40 to fall. The petals 52 of the bullet feed collet have also returned to their relaxed (closed) state, which has resulted in the bottommost bullet being obstructed by the petals 52. The petals 52 prevent the column of bullets from falling out the bottom 16 of the bullet feed die body.

For ongoing loading operations, the sequence of FIGS. 6-8 is repeated.

While a current embodiment of the bullet feed die assembly has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bullet feed die assembly comprising:
- a die body defining an interior passage;
- a first collet enclosed by the interior passage and defining a first bullet passage bore;
- a second collet enclosed by the interior passage and defining a second bullet passage bore;
- wherein the first collet and the second collet are positioned coaxially within the interior bore of the die body; and
- wherein the first collet and the second collet are each a tubular element having flexible petals spaced apart by elongated gaps.

2. The die assembly of claim 1, further comprising the first bullet passage bore and the second bullet passage bore having diameters that are variable based on an axial force applied to the collets.

3. The die assembly of claim 1, further comprising
- the first bullet passage bore having a larger diameter than the second bullet passage bore.

4. The die assembly of claim 2, further comprising:
- the first bullet passage bore having a diameter larger than a selected bullet diameter; and
- the second bullet passage bore having a diameter smaller than the selected bullet diameter.

5. The die assembly of claim 1, wherein at least one of the collets has an interior taper.

6. The die assembly of claim 1, wherein at least one of the collets has an exterior taper.

7. The die assembly of claim 1, wherein the collets are operably engaged to generate bore expansion of one of the bullet passage bores and bore restriction of the other bullet passage bore upon application of an axial force to the collets.

8. The die assembly of claim 1, further comprising:
- the first collet having an interior, exterior, a top, and a bottom;
- the interior of the top of the first collet being tapered outwards; and
- the exterior of the bottom of the first collet being tapered inwards.

9. The die assembly of claim 1, further comprising:
- the second collet having an interior, and exterior, a top, and a bottom;
- the interior of the top of the second collet being tapered outwards;
- the interior of the bottom of the second collet being tapered outwards; and
- the exterior of the bottom of the second collet being tapered inwards.

10. The die assembly of claim 7, further comprising:
- the first collet and the second collet being operably engaged with a released condition and an engaged condition;
- the first bullet passage bore being open to pass a bullet in the released condition;
- the second bullet passage bore being closed to stop a bullet in the released condition;
- the first bullet passage bore being closed to stop a bullet in the engaged condition; and
- the second bullet passage bore being open to pass a bullet in the engaged condition.

11. The die assembly of claim 10, wherein the first bullet passage bore and the second bullet passage bore are never both open to pass a bullet simultaneously.

12. The die assembly of claim 10, wherein the application of a predetermined amount of axial force to the first collet and the second collet transitions the collets from the released condition to the engaged condition.

13. A bullet feed die assembly comprising:
- a die body defining an interior passage;
- a first collet enclosed by the interior passage and defining a first bullet passage bore;
- a second collet enclosed by the interior passage and defining a second bullet passage bore;
- the first collet having a plurality of petals extending into its interior bore;
- the first collet's petals having a top that is tapered outwards;
- the second collet having a plurality of ridges extending into its interior bore;
- the second collet's ridges having a top that is tapered outwards; and
- the second collet's ridges having a bottom that is tapered outwards.

14. The die assembly of claim 13, further comprising the second collet's ridges narrowing the interior bore of the second collet more than the first collet's petals narrow the interior bore of the first collet.

15. The die assembly of claim 14, further comprising:
- the first collet having an interior, exterior, a top, and a bottom;
- the interior of the top of the first collet being tapered outwards; and the exterior of the bottom of the first collet being tapered inwards.

16. The die assembly-of claim 15, further comprising:

the second collet having an interior, and exterior, a top, and a bottom;

the interior of the top of the second collet being tapered outwards;

the interior of the bottom of the second collet being tapered outwards; and the exterior of the bottom of the second collet being tapered inwards.

17. The die assembly of claim 16, further comprising:

the inwardly tapered bottom exterior of the first collet and the outwardly tapered top of the second collet being operably connected with a released condition and an engaged condition;

the first collet's petals being open to pass a bullet in the released condition;

the second collet's ridges being closed to stop a bullet in the released condition;

the first collet's petals being closed to stop a bullet in the engaged condition; and the second collet's ridges being open to pass a bullet in the engaged condition.

18. The die assembly of claim 17, wherein the first collet's petals and the second collet's ridges are never both open to pass a bullet simultaneously.

19. The die assembly of claim 17, wherein the application of a predetermined amount of axial force to the first collet and the second collet transitions the collets from the released condition to the engaged condition by causing the top of the second collet to ride over and compress the bottom of the first collet, thereby closing the first collet's petals and opening the second collet's ridges.

20. A bullet feed die assembly comprising a die body having an interior bore;

a collet received in the interior bore the collet defining a first bullet passage bore having a first diameter;

the collet being operable in response to an application of force by contact with a cartridge case to change the diameter to a different second diameter, and wherein the collet has a first end that is circumferentially uninterrupted, and a second end in which the collet is axially slitted to provide flexible petals, and wherein the collet is tapered at the second end.

21. The die assembly of claim 20, wherein the greater of the first and second diameters is larger than a preselected bullet diameter, and the lesser of the first and second diameters is smaller than a preselected bullet diameter.

22. The die assembly of claim 21, wherein the collet is responsive to an axial force.

23. The die assembly of claim 22, wherein the collet is tapered.

24. The die assembly of claim 23, wherein the taper is external.

25. The die assembly of claim 23, wherein the taper is internal.

* * * * *